US005585776A

United States Patent [19]

Anderson et al.

[11] Patent Number: 5,585,776

[45] Date of Patent: Dec. 17, 1996

[54] THIN FILM RESISTORS COMPRISING RUTHENIUM OXIDE

[75] Inventors: Wayne Anderson, Hamburg; Franklyn M. Collins, Lewiston, both of N.Y.; Quanxi Jia, Los Alamos, N.M.; Kaili Jiao, Williamsville; Hoong J. Lee, Amherst, both of N.Y.

[73] Assignee: Research Foundation of the State University of NY, Albany, N.Y.

[21] Appl. No.: 149,445

[22] Filed: Nov. 9, 1993

[51] Int. Cl.[6] ..... H01C 1/012

[52] U.S. Cl. ..... 338/308; 338/314; 338/22 SD; 156/656.1; 204/192.21; 29/620

[58] Field of Search ..... 338/308, 314, 338/22 R, 22 SD, 195; 204/192.21; 437/19; 257/517, 519, 539; 29/620; 156/657, 659.1, 662, 663

[56] References Cited

U.S. PATENT DOCUMENTS

| | | | |
|---|---|---|---|
| 3,879,278 | 4/1975 | Grosewald et al. | 204/192 |
| 3,922,388 | 11/1975 | Schebalin | 427/103 |
| 3,947,277 | 3/1976 | Carnahan et al. | 106/26 |
| 4,016,050 | 4/1977 | Lesh et al. | 204/15 |
| 4,021,277 | 5/1977 | Shirn et al. | 156/657 |
| 4,104,607 | 8/1978 | Jones | 338/309 |
| 4,201,970 | 5/1980 | Onyshkevych | 338/195 |
| 4,284,970 | 8/1981 | Berrin et al. | 338/195 |
| 4,286,251 | 8/1981 | Howell | 338/309 |
| 4,454,495 | 6/1984 | Werner | 338/195 |
| 4,495,524 | 1/1985 | Kakuhashi et al. | 338/314 |
| 4,498,071 | 2/1985 | Plough, Jr. et al. | 338/308 |
| 4,579,600 | 4/1986 | Shah et al. | 148/1.5 |
| 4,708,915 | 11/1987 | Ogawa et al. | 428/698 |
| 4,746,896 | 5/1988 | McQuaid | 338/314 |
| 4,766,411 | 8/1988 | Prieto | 338/306 |
| 4,803,457 | 2/1989 | Chapel, Jr. et al. | 338/195 |
| 4,849,611 | 7/1989 | Whitney et al. | 219/538 |
| 5,254,217 | 10/1993 | Maniar et al. | 156/656 |
| 5,276,423 | 1/1994 | Breit et al. | 338/308 |
| 5,367,285 | 11/1994 | Swinehart et al. | 338/308 |
| 5,425,099 | 6/1995 | Takakura et al. | 379/413 |

*Primary Examiner*—Tu Hoang

*Attorney, Agent, or Firm*—Christine Johnson, Esq.; George Blasiak, Esq.

[57] ABSTRACT

In a first embodiment of the invention a layer of ruthenium oxide is reactively deposited onto a substrate, then annealed for TCR adjustment and for stabilization. In a second, bi-layer embodiment of the invention, a layer of tantalum nitride is first reactively deposited onto a substrate, then annealed for stabilization. After a ruthenium oxide layer is reactively deposited onto the annealed tantalum nitride layer, the structure is annealed until a near-zero effective TCR for the bi-layer resistor is achieved. The ruthenium oxide capping layer serves as a barrier against chemical attack.

17 Claims, 4 Drawing Sheets

THIN FILM RESISTORS COMPRISING RUTHENIUM OXIDE

BACKGROUND OF THE INVENTION

This invention relates to thin film resistors and more particularly to thin film resistors having a low temperature coefficient of resistance (TCR), good stability, and good resistance to corrosion.

Commercially available thin film resistors are mainly fabricated from either nichrome (NiCr) or tantalum nitride ($Ta_2N$). Unfortunately, performance limitations have been noted with resistors comprising either of these materials. For example, a particularly significant problem observed with nichrome resistors is that chromium oxidizes when exposed to air. Oxidization of chromium causes the TCR of nichrome to become more negative over time and results in a limited shelf life for resistors fabricated from such material. While tantalum nitride resistors do not oxidize as rapidly as nichrome resistors, they too tend to degrade over time at a rate that is unacceptable for certain precision applications.

The rate of degradation of currently available NiCr or $Ta_2N$ resistors increases when such resistors are exposed to stressful thermal, humidity, or power loading conditions.

In addition to their stability limitations, currently available NiCr or $Ta_2N$ resistors are unable to withstand exposure to certain chemicals especially common in chemical industry environments. Exposure to HF or HCL vapors, for example, or acids such as $H_2SO_4$, will change drastically the electrical characteristics of resistors fabricated from either material.

In the meantime, the unique physical properties of the material ruthenium oxide have attracted increasing attention from researchers and scientists. Recent studies concerning various applications for the material have shown that ruthenium oxide exhibits excellent stability over time, excellent stability when exposed to thermal stress, excellent stability with respect to changes in humidity, excellent diffusion barrier characteristics, and excellent resistance to corrosion upon exposure to certain chemicals, even against chemicals that other materials traditionally employed as corrosion barriers, such as $Ta_2N$, are unable to withstand.

Thick film resistors utilizing ruthenium oxide have been thoroughly investigated and are currently available. However, applications for such resistors are severely limited because of disadvantages inherent in thick film resistor processing. As compared to thin film resistors, it is well known that thick film resistors are unreliable, large, and have poor high frequency response. Furthermore, a variance of resistivity of about 20% is unavoidable with thick film resistors owing to the distribution of thickness of the thick film and unstable firing conditions. These problems inherent with thick film processing make thick film ruthenium oxide resistors unsuitable for many applications including most precision applications.

In light of the limitations of materials presently used in thin film resistor systems, and further in light of the inherent disadvantages of thick film resistor processing, it is a principal object of the present invention to provide a thin film resistor comprising ruthenium oxide which, by way of easily reproduced process controls, exhibits a near-zero temperature coefficient of resistance, and which, in addition, exhibits excellent stability over time (shelf-life stability), excellent stability when exposed to stressful thermal, humidity, or power loading conditions, and excellent resistance to chemical erosion.

Other objects of the present invention are to provide a simplified fabrication process for stable thin film resistors, to provide a resistor with a good termination layer for metallization, and to provide a resistor which can be assembled and packaged flexibly and economically.

Further objects of the present invention will become apparent from the ensuing description.

SUMMARY OF THE INVENTION

In a first embodiment of the present invention, a layer of ruthenium oxide is reactively deposited onto a substrate. Annealing of the deposited ruthenium oxide layer stabilizes the structure and adjusts the TCR exhibited by the resistor to a near-zero value.

In a second embodiment of the present invention a resistor is formed wherein slight instabilities of a first, tantalum nitride layer are compensated by the slight instabilities of a second, ruthenium oxide layer in the formation of an ultra-stable bi-layer resistor. The bi-layer resistor is formed by first reactively depositing a layer of tantalum nitride onto a substrate then annealing said layer preferably until it exhibits a slightly negative TCR in the range of from about 0 to −150 ppm/° C. A layer of ruthenium oxide is then reactively deposited onto the annealed tantalum nitride layer. After depositing the ruthenium oxide layer, the resulting structure is annealed until the ruthenium oxide layer exhibits a slightly positive TCR preferably in the range of from about 0 to 150 ppm/° C., compensating that of the tantalum nitride layer such that the bi-layer structure exhibits a near-zero TCR. In addition to other attendant advantages, the ruthenium oxide capping layer provides an excellent barrier against chemical erosion.

DETAILED DESCRIPTION OF THE SINGLE-LAYER EMBODIMENT

Figure 1:
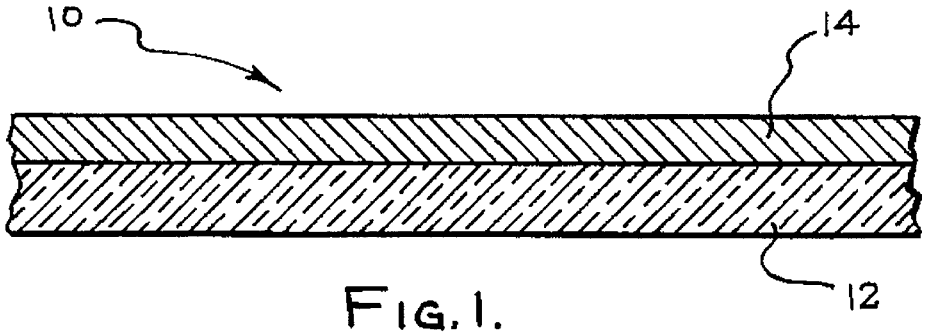
FIG. 1 is a cross-sectional view of a first embodiment of the present invention comprising a single layer of ruthenium oxide deposited on a substrate.

Referring to FIG. 1, the first embodiment of the present invention 10 comprises a substrate 12, and a layer of ruthenium oxide 14 deposited onto said substrate, then annealed.

Suitable substrates upon which the ruthenium oxide layer may be deposited include $Al_2O_3$, $SiO_2$/Si, AlN, or $Si_3N_4$/Si. Preferably, the substrate is cleaned or otherwise treated to remove contaminations.

Multiple deposition means may be used for depositing the ruthenium oxide layer. Generally, methods useful in depositing the film include dc or rf sputtering (with or without magnetron), electron beam evaporation, or metal organic chemical vapor deposition (MOCVD). A most preferred deposition means is dc magnetron sputtering.

Before depositing the film via dc magnetron sputtering, it is preferred that some preparatory steps be taken. First the substrate should be heated to a desired temperature and stabilized at the temperature for more than 30 min. Also, presputtering should be performed for a time sufficient to clean the target surface, to bring target to a thermal equilibrium condition, and to stabilize the total sputtering gas pressure. Before sputtering, the system should be pumped to a base pressure of less than 5 μTorr.

Thin films of ruthenium oxide are preferably deposited in an argon/oxygen atmosphere with oxygen partial pressure in the range of from about 0.1 mTorr to 1 mTorr and total gas pressure of from about 3 mTorr to 20 mTorr. Preferred values for these parameters are 0.5 mTorr oxygen partial pressure and 10 mTorr total gas pressure. It should be highlighted that the surface layer of the film will tend to reoxidize and result in an unstable resistor if the ruthenium oxide layer is deposited at an oxygen partial pressure of lower than about 0.1 mTorr.

Using a 99.9% pure ruthenium target 2 inches in diameter, acceptable power density input values range from about 0.35 W/cm$^2$ to 5 W/cm$^2$. Acceptable target-to-substrate distances for the system, meanwhile, range from 6 to 9 cm.

Sputtering rate, determined by input power and target-to-substrate distance may vary from 10 to 700 Å/min, although a deposition rate of between about 40 Å/min and 80 Å/min is preferred so that a highly uniform layer of $RuO_2$ is deposited that meets the needs of industrial production.

A feature of ruthenium oxide thin films worthy of particular note is that the TCR exhibited by the film shows no apparent dependence on input power density within investigated ranges of 0.5 to 4.6 W/cm$^2$. With other materials, an increase in TCR with increasing power density is observed due to the self-heating effect from the high energy particle bombardment to the substrate and plasma. Because no such self-heating is observed with magnetron sputtered ruthenium oxide films, power density may be adjusted for different applications (assuming corresponding adjustment of sputtering time) without considering the effect of that adjustment on the exhibited TCR of the deposited film. For example, a 60 nm $RuO_2$ film deposited with a power density of about 4.93 W/cm$^2$ for 60 s will exhibit substantially the same electrical characteristics as a 60 nm film deposited for about 5 min with a power density of about 1.10 W/cm$^2$.

Adjusting the TCR of Single Layer Ruthenium Oxide Films

As can be seen with reference to Table 1, it is possible to adjust the TCR of ruthenium oxide films by controlling oxygen partial pressure. However, the TCR is more easily and more precisely adjusted by fixing the system's gas pressure (preferably at 0.5 mTorr oxygen, 10 mTorr total) and varying only substrate deposition temperature and post-deposition annealing time and temperature.

TABLE 1

Effect of oxygen partial pressure on TCR and resistance of $RuO_2$ films deposited at room temperature and with total pressure of 10 mTorr.

| Sample | Oxygen pressure (mTorr) | Resistance (ohms) | TCR (ppm/°C.) |
|---|---|---|---|
| 1 | 0.5 | 763.4 | −268.3 |
| 2 | 0.1 | 745.0 | −281.6 |
| 3 | 0.05 | 762.2 | −382.7 |
| 4 | 0.01 | 362.6 | 135.5 |
| 5 | 0.005 | 330.6 | 304.8 |
| 6 | — | 215.3 | 447.6 |

Figure 2:
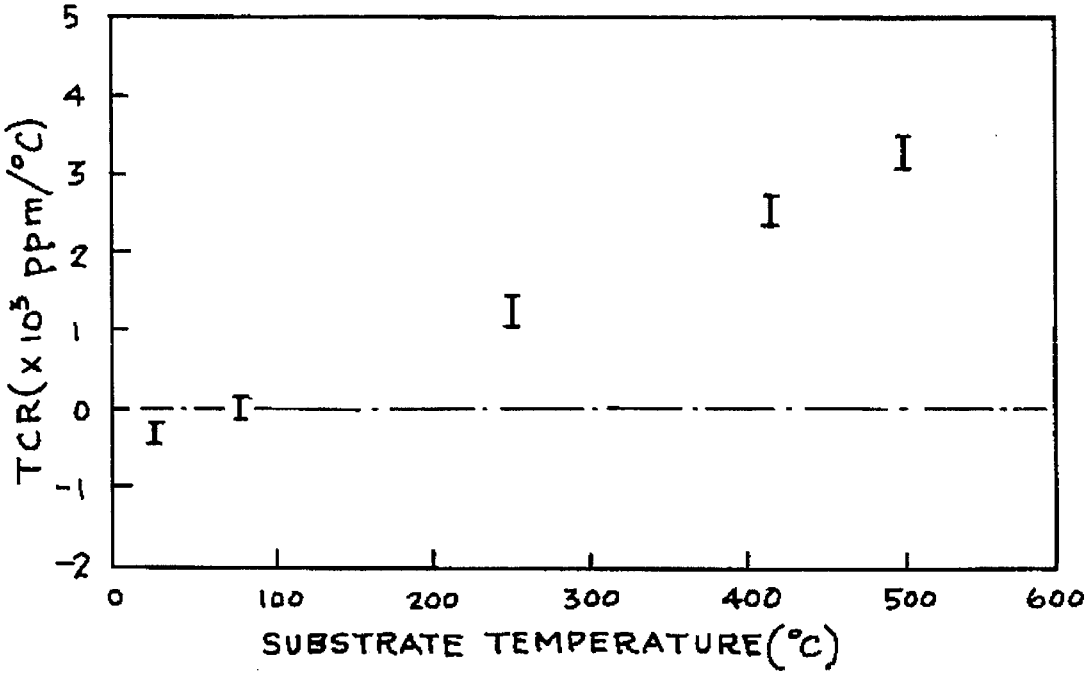
FIG. 2 is a correlation graph demonstrating the relationship between deposition substrate temperature and post-deposition TCR where single-layer ruthenium oxide films are deposited under otherwise fixed conditions.

Reference will now be made to FIG. 2, a correlation graph illustrating the effect of substrate temperature on the post-deposition TCR exhibited by the single layer where films having thicknesses ranging from 60 nm to 90 nm are deposited at 10 mTorr total, 0.5 mTorr oxygen partial pressure, in a system where the substrate is about 7.5 cm from a 2 in ruthenium target. It is seen from the correlation graph that increasing the deposition substrate temperature has the general effect of changing the film's TCR (from about −270 ppm/° C. to about 3000 ppm/° C. where temperature is increased from 25 to 500 deg. C.) and it is further observed from the figure that by depositing the film at a temperature of about 80° C., the film will exhibit a post-deposition initial TCR of about zero.

However, near-zero TCR films fabricated using such a direct, deposit-only approach are highly unstable. That is, although a resistor deposited as such will exhibit an initial TCR of about zero, its TCR will change substantially over time whether it remains on a shelf or whether it is subjected to various aging tests.

For fabrication of stable, low TCR $RuO_2$ resistor an annealing step is required. An in-situ oxygen annealing process is preferred from a performance standpoint. With in-situ oxygen annealing, films are annealed immediately after deposition without breaking the system vacuum. Immediately after deposition, the substrate is warmed preferably at a rate of 15° C./min to its desired temperature while oxygen is introduced into the chamber to a pressure of more than 2 Torr. The substrate temperature is held for 60 min. after which time the chamber is evacuated to less than 50 mTorr. When the chamber is evacuated, the substrate is cooled by shutting off the power supply to the substrate heater.

Figure 3:
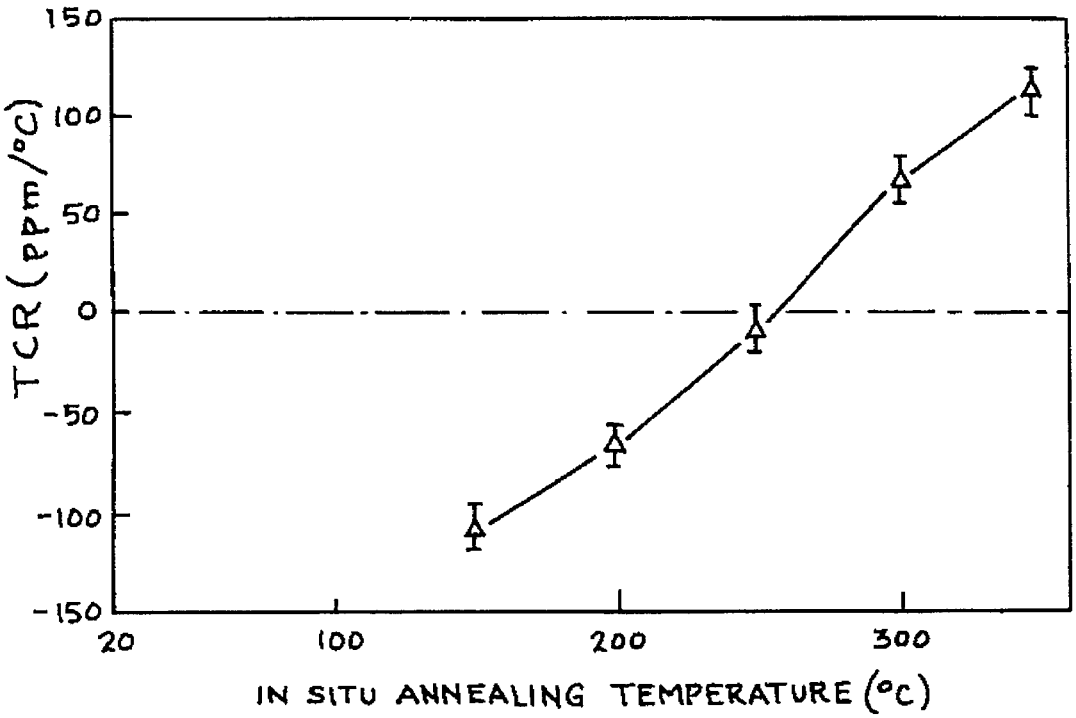
FIG. 3 is a correlation graph demonstrating the relationship between in-situ oxygen annealing temperature and post-annealing TCR where single-layer ruthenium oxide films are deposited under fixed conditions at room temperature.

FIG. 3 illustrates the effect of in-situ oxygen annealing temperature on the TCR of ruthenium oxide resistors deposited using the sputtering system input controls described above. Generally, increasing annealing temperature increases the post-annealing TCR of the structure. By comparing FIGS. 2 and 3, methods for adjusting the TCR of stable ruthenium oxide films are apparent. It is seen that as long as the films are deposited to exhibit a negative post-deposition TCR, annealing may be used to adjust the TCR to about zero. Preferably however, the annealing temperature is substantially greater than normal operating temperature (of between 25° C. and 150° C.). Where films having thicknesses ranging from 60 nm to 90 nm are deposited at room temperature to exhibit a post-deposition TCR of about −270 ppm/° C., a 60 min annealing temperature of about 250° C., substantially above normal operating temperature, adjusts the post-annealing TCR of the films to about zero (resistance was measured by evaporating Au contacts pads on the films and TCR was measured by measuring the change in resistance of the films as temperature was increased from 25° to 85° C.).

In the alternative, a simple air annealing process may also be used to adjust the TCR of a ruthenium oxide film to about zero. Specifically, transferring a room-temperature-deposited film (of between about 60 and 90 nm in thickness, deposited at 0.5 mTorr partial pressure, 10 mTorr total pressure) into an oven heated to about 250° C. for between 40 and 60 minutes results in a stable resistor having a TCR of about zero. Although air annealing results in resistors somewhat less stable than those annealed by in-situ oxygen annealing, the technique may be preferred for mass production purposes since it frees the deposition system.

The TCR of annealed $RuO_2$ films showed no observable dependence on layer thickness within the investigated range of from about 60 nm to about 90 nm.

Stability of Single-Layer Ruthenium Oxide Resistors

Patterned ruthenium oxide thin film resistors formed under the conditions described above (10 mTorr pressure, 0.5 mTorr partial pressure, 60–90 nm thickness, room temperature deposition, oxygen annealed at 250° C. for 60 min) were subjected to a variety of stability tests, and generally showed excellent results.

EXAMPLE 1

Figure 4:
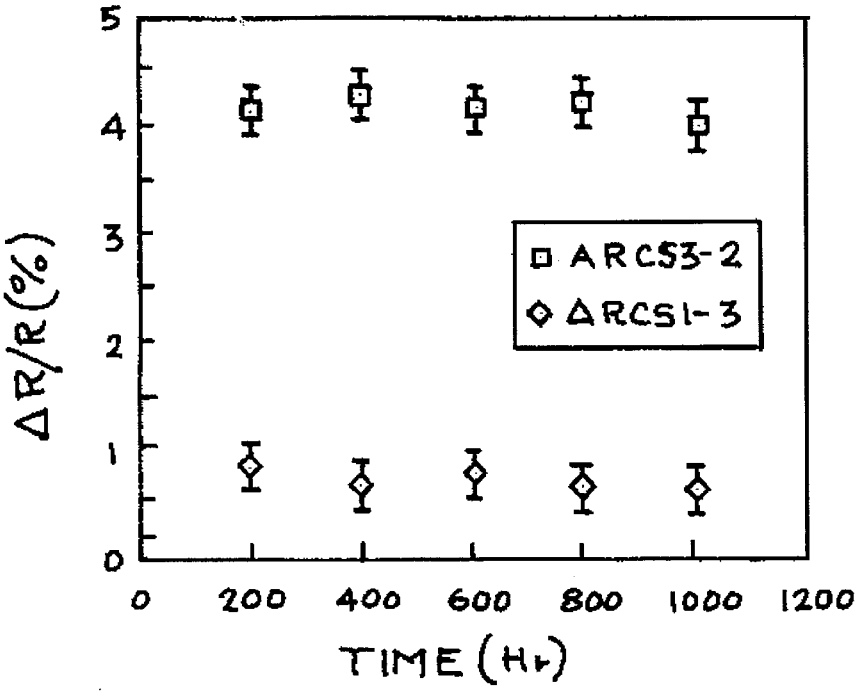
FIG. 4 is a graph demonstrating the resistance stability of ruthenium oxide films when subjected to stressful thermal conditions.
Figure 4A:
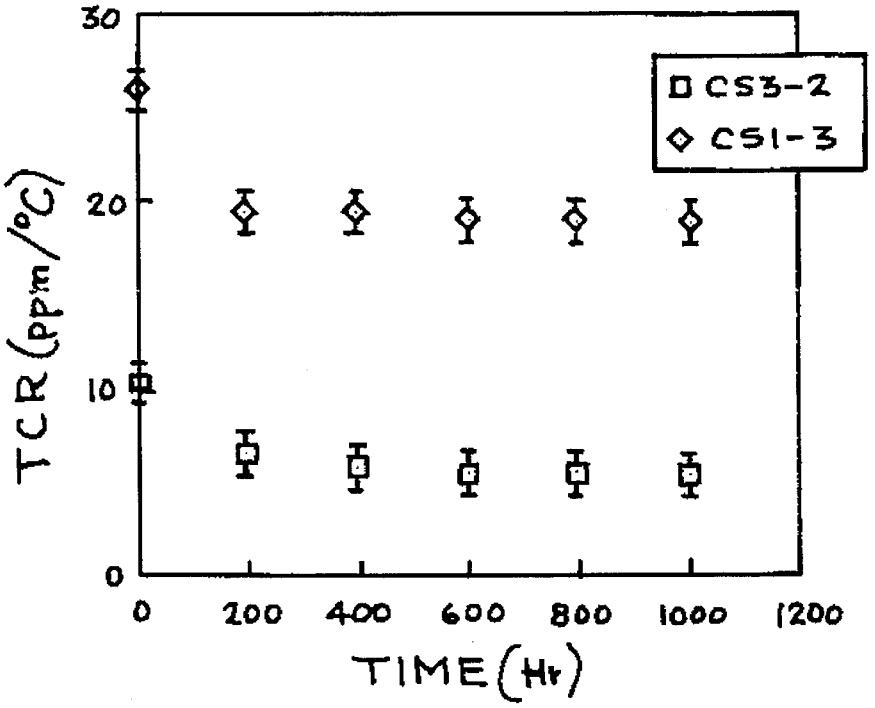
FIG. 4A is a graph demonstrating the TCR stability of ruthenium oxide films when subjected to stressful thermal conditions.

A long-term thermal aging test at 150° C. was chosen to examine the thermal stability of $RuO_2$ thin film resistors. Au contact pads were evaporated on the resistors and data on resistance and TCR were recorded in 200 h intervals for a consecutive 1000 h. The results are shown in FIGS. 4 and 4A. It is observed that, for the first 200 h, the TCR decreased about 4–6 ppm/° C. and the relative change in resistance was about 3–5%. After the first 200 h, the TCR and resistance remained almost constant, and only some trivial fluctuation was found which may be due to the uncertainty of the measurements. The first 200 h at 150° C. can be considered a burn-in process for achieving improved stability. Subsequent tests revealed that the most significant changes are observed within the first 100 hours of 150° C. thermal treatment. After the first 200 h, the relative change in resistance was within 0.2% and the change in TCR was 5–10 ppm/° C. In comparison, the industry standard is 1000 ppm/° C. after such a 1000 h test.

EXAMPLE 2

A power aging test was performed to examine the stability of the resistors under working conditions and to determine the maximum tolerance against applied bias. Power density was controlled by the surface area of the thin film resistors. The test was performed using a regulated dual-power supply. No intentional cooling or heating was applied during the test while the sample was heated only by the dissipated power balanced with the environment. The testing cycle was as follows: (a) 250 W/in$^2$ for 1 week, followed by (b) 500 W/in$^2$ for 1 week, followed by (c) 750 W/in$^2$ for 1 week. The voltage and current were monitored during the test with the voltage regulated to within 1%. The results were as follows:

| | Voltage (V) | Current (mA) | R (ohms) | TCR (ppm/°C.) |
|---|---|---|---|---|
| Before test | | | 834.5 | −16.3 |
| After (a) | 50.9 | 60.5 | 851.1 | −17.5 |
| After (b) | 70.0 | 88.6 | 854.0 | −17.5 |
| After (c) | 89.2 | 104.0 | 784.0 | +71.7 |

It is observed that, for a power below 500 W/in$^2$, the TCR remains unchanged although the absolute resistance increased by about 2% after the 250 W/in$^2$ cycle. After 750 W/in$^2$, the TCR became quite positive and the absolute resistance decreased by 70 ohms or 8%. This is believed to be the effect of a combined electric and thermal stress. A relatively high temperature (about 150° C.) which was built up from the dissipated power, was measured from the sample holder while, for the low power cycles, this temperature was lower than 70° C.

EXAMPLE 3

Humidity tests (or moisture resistance tests) were carried out in a small bell-jar. The water vapor was introduced and the flux was controlled by a heater. During the tests, the inside relative humidity was maintained at above 95% and the temperature at 65°–70° C. The resistance was monitored with a digital meter and only a slight change was found with the testing time. The tests contained a short-term component and a relative long term component.

The short-term test was in a three-step procedure: (a) 8 h without an applied voltage, followed by (b) 24 h without an applied voltage, followed by (c) 8 h with a 50 V applied voltage. Step (c) was a combination of the humidity and power-aging tests. The results were as follows:

| | R (ohms) | TCR (ppm/°C.) |
|---|---|---|
| Initial | 699 | 14.3 |
| After (a) | 701 | 12.5 |
| After (b) | 701 | 11.6 |
| After (c) | 734 | 20.0 |

It is observed that the stability of $RuO_2$ thin film resistors under high humidity is very good. Without the applied voltage, there is a slight tendency of the TCR to decrease and the resistance to increase. With the applied voltage, the TCR and resistance increased slightly which was similar to the results of the power-rating tests.

Figure 5:
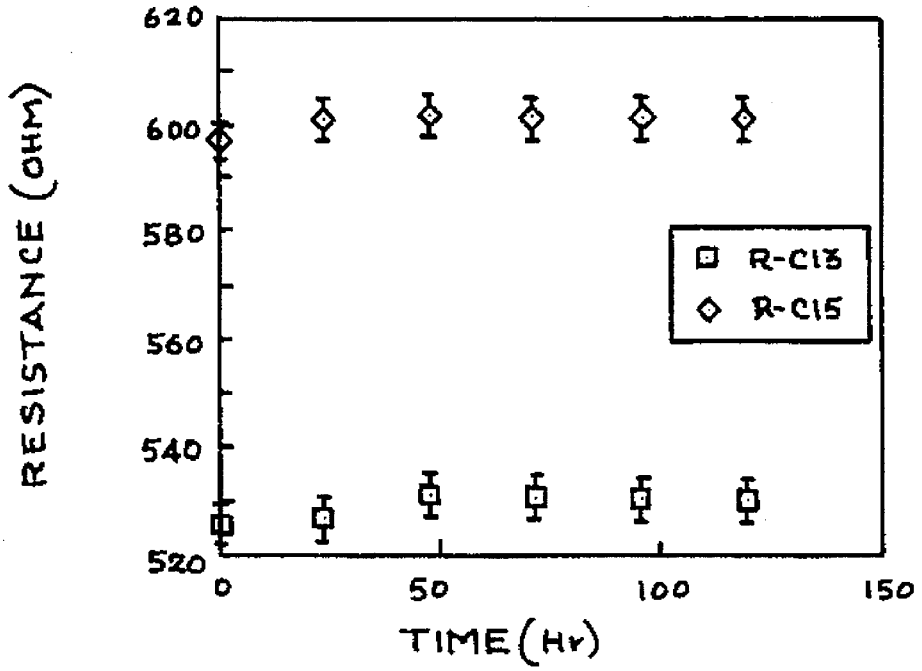
FIG. 5 is a graph demonstrating the resistance stability of ruthenium oxide films when subjected to stressful humidity conditions.
Figure 5A:
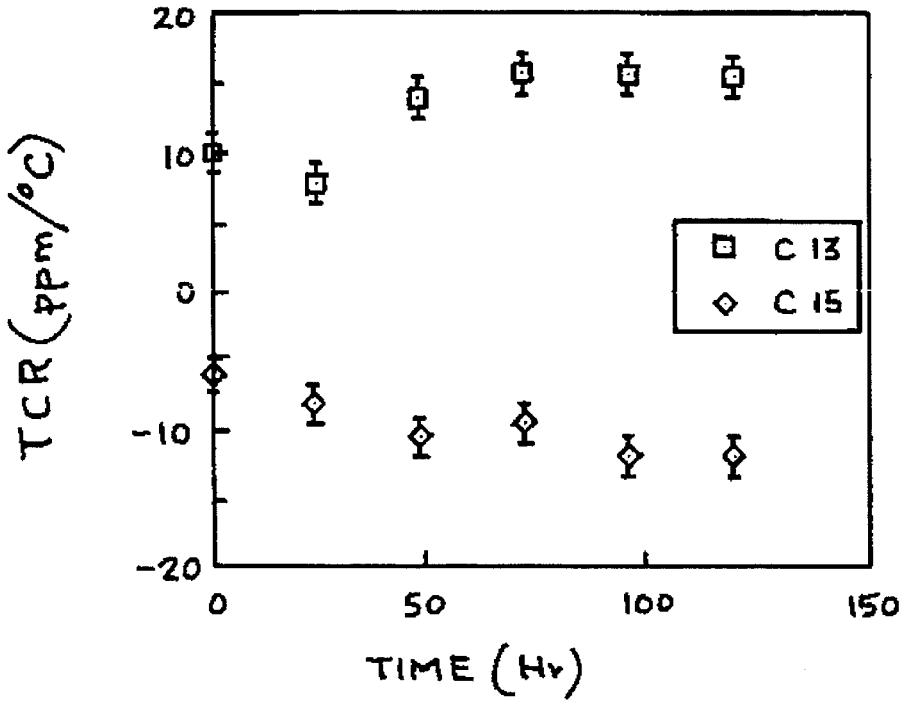
FIG. 5A is a graph demonstrating the TCR stability of ruthenium oxide films when exposed to stressful humidity conditions.

The long-term humidity test was conducted for a consecutive 120 h in which the TCR was examined at 24 h intervals. FIGS. 5 and 5A illustrate the results for two samples. Again, only small variations in resistance and TCR were observed for the first 24 or 48 h, after which there were no significant changes.

DETAILED DESCRIPTION OF THE BI-LAYER EMBODIMENT

While the results described above for the single layer system are certainly impressive, the stability performance of any single layer resistive system will always have limitations. Thus, although the single layer ruthenium oxide resistor exhibited very small changes in both TCR and resistivity during 1000 hour aging tests in various hostile environments, it is expected that the slight changes will become more noticeable as the period is extended to months or years.

The instabilities of ruthenium oxide films realized over very long periods may be compensated for with the addition of a second layer into the resistive structure. Building upon their extensive research of conventional thin film resistor materials, the inventors have developed techniques for fabricating tantalum nitride thin films such they exhibit stability characteristics very similar to the results described above for ruthenium oxide films. Because the stability characteristics of stabilized ruthenium oxide and tantalum nitride thin films are closely matched, an ultra-stable thin film resistive structure may be formed by depositing and annealing a layer of ruthenium oxide film over a deposited-and annealed layer of tantalum nitride film, such that one of the layers has a positive TCR and the other layer has a negative TCR. The system, in addition to being much more stable than currently available bi-layer resistive structures, takes advantage of the excellent physical properties of ruthenium oxide including the material's ability to resist chemical attack.

The bi-layer embodiment of the invention may also be realized by depositing and annealing a ruthenium oxide film over a deposited and annealed ruthenium oxide film having an opposite-sign TCR. Despite exhibiting excellent stability, the characteristics of bi-layer $RuO_2/RuO_2$ films are not as controllable or as reproducible as $Ta_2N/RuO_2$ films.

Figure 6:
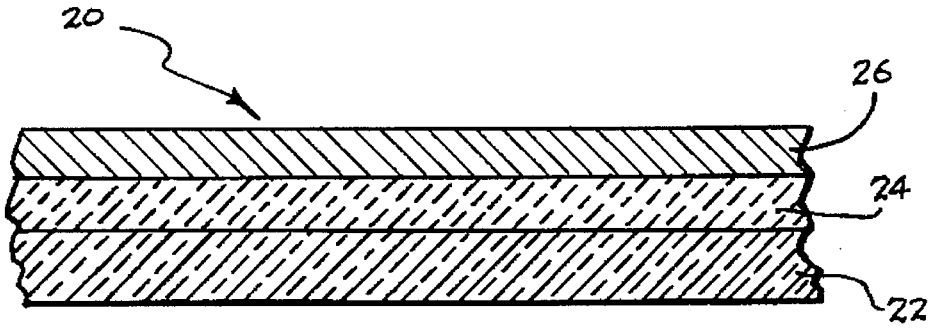
FIG. 6 is a cross-sectional view of the preferred second embodiment of the invention comprising a substrate, a layer of tantalum nitride, and a capping layer of ruthenium oxide.

FIG. 6 shows the preferred bi-layer embodiment of the present invention 20. A layer of tantalum nitride 24 is deposited and annealed over a substrate 22, and a layer of ruthenium oxide 26 is deposited and annealed over the annealed tantalum nitride layer.

Although it does not take into account the complex electrical properties at the interface between the $Ta_2N$ and $RuO_2$ layers or between the substrate and the $Ta_2N$ layer, a formula useful in developing alternative designs of the bi-layer structure is the formula for effective TCR of a parallel thin film system:

$$TCR_{eff}\|=(R2/(R1+R2))TCR1+(R1/(R1+R2))TCR2 \quad \text{Eq. 1}$$

where R1 and TCR1 are the resistance and TCR respectively of the first layer and R2 and TCR2 are the resistance and TCR respectively of the capping layer.

It is observed that care must be exercised in the formation of the bi-layer structure so that the layers do not have TCR's of the same sign. If the layers have TCR's of the same sign, both their TCR and resistivity will change over time in the same direction, and the design goal of offsetting the instabilities of the layers will not be achieved.

Now referring to specifics of $Ta_2N/RuO_2$ resistor processing, suitable substrates upon which tantalum nitride may be deposited include $Al_2O_3$, $SiO_2/Si$, AlN, or $Si_3N_4/Si$, preferably prepared by cleaning and or otherwise treating the substrate to remove contaminations.

Preferably, tantalum nitride films are deposited by means of dc magnetron sputtering, although other deposition means, including dc sputtering without magnetron, rf sputtering with or without magnetron, electron beam evaporation, or MOCVD may also be used.

Before depositing tantalum nitride films via dc magnetron sputtering, the substrate is heated to its desired temperature and stabilized at that temperature, the system is pumped to a base pressure of less than 5 μTorr, and presputtering is performed.

The films are deposited in an atmosphere of nitrogen and argon with total gas pressure in the range of from about 3 to 20 mTorr and nitrogen partial pressure in the range of from about 30 μTorr to 1 mTorr.

Power density using a 2 in tantalum target may range from 1 to 5 $W/cm^2$ and the target-to-substrate distance is preferably 6 to 9 cm.

The preferred ranges for dc sputtering ruthenium oxide film on a substrate apply where ruthenium oxide is deposited on an annealed layer of tantalum nitride.

Adjusting the TCR of Tantalum Nitride Thin Films

Several deposition parameters will have at least some affect on the TCR of a dc sputtered layer of tantalum nitride film including nitrogen partial pressure, total gas pressure, and sputtering rate (a function of power density and target-to-substrate distance). As is the case with the single-layer ruthenium oxide structure, however, a preferred means of adjusting the TCR of tantalum nitride is by coordinating substrate deposition temperature and annealing temperature, fixing all other deposition parameters, except sputtering time, which is adjusted where different layer thicknesses (for different sheet resistances) are desired.

Tantalum nitride films are preferably annealed by in-situ vacuum annealing. With this method, the system vacuum pressure is maintained at about the same pressure as during deposition, and the substrate is heated to a desired temperature.

In the alternative, though the results are somewhat less favorable in terms of the stability achieved for the layer, a simple air annealing process may be used whereby after deposition of tantalum nitride the film is transferred into an oven.

EXAMPLE 4

Tantalum nitride films were deposited on ceramic substrates. The system was pumped to a base pressure of about 5 μTorr, and presputtering was performed for about 5 minutes. The substrate was about 8 cm from the 2 in tantalum target and the films were sputtered in an atmosphere of nitrogen, and argon. Partial pressure was about 1 mTorr and total gas pressure was about 10 mTorr. System input voltage was about 380 V and current was about 0.2 Å. Sputtering lasted about 15 minutes.

Films deposited as such exhibited post-deposition TCR values in the range of −600 ppm/° C. to −800 ppm/° C. Air annealing the samples for 30 min. at various temperatures produced the following results, where resistance was measured by evaporating gold contact pads and measuring the change in resistance of the samples as temperature was increased from 25° C. to 85° C.

| Anneal. Temp. (deg. C.) | TCR ppm/C. |
|---|---|
| 500 | −345 |
| 550 | −138 |
| 600 | −92 |
| 650 | −64 |

It is seen generally that the post-annealing TCR of the films may be adjusted by adjusting annealing temperature. It is apparent that similar tables may be generated without undue experimentation for other tantalum nitride films deposited under different conditions and stabilized by the same technique or by in-situ vacuum annealing.

Adjusting the TCR of the Bi-Layer Structure

Once the tantalum nitride layer is deposited and annealed the ruthenium oxide layer is deposited and annealed such that the structure exhibits a near-zero TCR in the range of from about −50° to +50 ppm/° C. Preferably, the TCR exhibited by the hi-layer structure is adjusted by fixing the parameters of deposition for the layer of ruthenium oxide and varying only the post-deposition annealing conditions (except where different layer sheet resistances are desired, in which case sputtering time and annealing conditions are also adjusted). It is noted with reference again to FIG. 2 that where ruthenium oxide is deposited on a substrate in 0.5 mTorr oxygen and 10 mTorr total pressure at room temperature, the film exhibits a post-deposition TCR of about −270 ppm/° C. It is expected that the layer will have about the same TCR where it is deposited under the same conditions on an annealed tantalum nitride layer (though it is very difficult to investigate the individual characteristics of a second layer in a two layer system). Further, it is noted generally that increasing annealing temperature will increase the film's post-annealing TCR. Thus, for any tantalum nitride layer deposited and annealed to exhibit a TCR in the range of from about −500 ppm/° C. to 200 ppm/° C., a near-zero TCR for the bi-layer structure may be achieved by depositing a layer of ruthenium oxide preferably at room temperature and adjusting the annealing time or temperature for the layer. Most preferably, the tantalum nitride layer is deposited and annealed to exhibit a post-annealing TCR in the range of from about −30 to −140 ppm/° C.

The ruthenium oxide capping layer may be annealed by a simple air annealing process whereby after deposition the bi-layer structure is transferred to an oven.

In the alternative, a ramp annealing process may be used whereby bi-layer structures are transferred to an oven and oven temperature is gradually increased at a rate of about 60° C./min until a desired temperature is achieved at which point the oven power is turned off.

In general the capping layer may be annealed at low temperatures (between 150 and 300 deg. C.) for long periods (more than 2 hours) or at high temperatures (300 deg. C. and above) for intermediate periods (0.5 to 1 hours). Structures having high sheet resistances are generally annealed at high temperatures for short period (under 30 minutes) and then at lower temperatures for intermediate periods. Using air or ramp air annealing, the bi-layer structures may be removed from the oven from time to time and cooled for TCR measurement then placed back into the oven if additional annealing is required.

Regardless the annealing process selected, the annealing temperature for the second layer is preferably lower than the annealing temperature for the first layer. If the second layer's annealing temperature is substantially higher than that of the first layer, annealing of the second layer will substantially affect the characteristics of both the second and the first layers, and will add unnecessary complexity to the process controls required for achieving the ultra-stable, low TCR bi-layer structure.

Further, with reference again to Eq. 1, it is observed that the degree to which adjusting the TCR of the capping layer impacts the effective TCR of the structure is dependent on the ratio of R1 to R2. With a small R1/R2 ratio, the process of the invention may be carried out with very fine precision since large changes in TCR of the second layer will have only a small impact on the effective TCR of the bi-layer structure. It is therefore preferred generally that the ruthenium oxide layer is deposited to exhibit a higher sheet resistance than the $Ta_2N$ layer. However, the consideration of precision must be balanced against other concerns. The capping layer cannot be too thin (below about 20 nm) or it will not feature uniformity of deposition, nor will it provide optimum protection for the underlying layer. Furthermore, of course, the sheet resistance of $Ta_2N$ must be greater than the desired sheet resistance for the structure.

Although the results are less controllable, and fewer variations of the invention are possible, the process of the invention may be carried out by annealing the structure only once (after deposition of the ruthenium oxide film), omitting the step of annealing the tantalum nitride layer individually.

EXAMPLE 5

Several bi-layer structures were deposited and annealed on ceramic substrates under the following conditions: With a 2 in target of tantalum about 8 cm from the substrate, the system was pumped to a base pressure of about 3 μTorr, and presputtering was performed for about 12 minutes. Nitrogen and Argon were introduced into the chamber until total gas pressure was about 10 mTorr and reactive gas pressure was about 0.5 mTorr. Input voltage and current were about 360 V and 0.2 A respectively. The films were sputtered for either 10 or 15 minutes.

Deposited layers of tantalum nitride were then vacuum annealed for about 20 min. at either 450° or 550° C. (20 minutes refers to the period during which temperature is held constant, after a warm-up period of about 10 min, and before a natural cool-down period of more than 30 minutes).

For deposition of the ruthenium oxide layer, the system base pressure was once again pumped to about 3 μTorr. A 2 in. target of ruthenium was placed about 8 cm from the substrate. Presputtering was performed for about 7 minutes. Total gas pressure (Ar+O2) was about 10 mTorr and oxygen partial pressure was about 0.5 mTorr. Input voltage was about 410 volts, input current was about 0.2 A, and the films were sputtered for about 30 seconds.

After deposition of the RuO2 layer the affects of various air annealing times and temperatures on the samples were investigated. Gold contact pads were evaporated on the films for measuring of resistance and TCR was measured by measuring the change in resistance as temperature was increased from 300 and 355 deg. K. The results are summarized in Table 2, where TCR1 is the TCR of the bi-layer structure before annealing of the ruthenium oxide layer and TCR2 is the TCR of the bi-layer structure after air annealing. The TCR of the structure after annealing of the tantalum nitride layer was not measured since the structure remains in the chamber for $RuO_2$ deposition after it is in-situ annealed.

The results demonstrate generally that low temperature, long term annealing or in the alternative, high temperature, intermediate-term annealing may be used to adjust the TCR of samples formed under a variety of different conditions to a near zero value. The results further show that a process of iteration may be used to arrive at suitable annealing parameters for bi-layer structures formed under a variety of conditions. Still further, the reproducibility and controllability of the invention are illustrated by comparing either samples 1a and b or samples 3a and b. The results demonstrate that if samples are formed under controlled, identical conditions they will exhibit similar TCR's after deposition of the $RuO_2$ layer, which will be adjusted to a near zero value if similar annealing conditions are used for each of the structures formed under the controlled conditions.

Comparing samples 1 and 2 it is further observed that as tantalum nitride vacuum annealing temperature increases, then, as expected, the post-annealing TCR of the film will become less-negative (as evidenced by the less-negative TCR for the unannealed parallel structure). A comparison of samples 2 and 3 shows, as generally expected, that vacuum annealing at a fixed temperature has a lesser affect on the post-annealing TCR of thinner films than on thicker films. The results still further reveal generally that unannealed bi-layer films having more-negative TCR values require more annealing (either at higher temperature or for longer periods) than those with less-negative TCR values.

Adjusting Sheet Resistance of the Bi-Layer Structure

Although several deposition parameters will have at least some effect on the resistivity of the layers, the preferred means of adjusting the effective sheet resistance of the hi-layer structure is by adjusting the thickness of the layers and more particularly, by adjusting deposition time. Adjusting layer thickness requires adjustment of annealing conditions.

EXAMPLE 6

Tantalum nitride films were deposited by way of dc magnetron sputtering on alumina substrates. The system was pumped to a base pressure of less than 2 μTorr and presputtering was performed for 10 minutes. Target-to-substrate distance was 8 cm (a 2 in target was used), power density was about 2.6 W/cm$^2$, nitrogen partial pressure was about 30 μTorr, and total gas pressure was about 10 mTorr. Substrate temperature during deposition was about 50° C. Deposition time was varied between 15, 7.5, and 2 minutes.

After deposition of the tantalum nitride layer, the films were in-situ vacuum annealed for about 5 minutes at about 450° C.

A layer of ruthenium oxide was then deposited over the annealed tantalum nitride layer. The system was pumped to a base pressure of lass than 2 μTorr and presputtering was performed for about 5 minutes. Substrate-to-target (2 in Ru) distance was about 8 cm, power density was about 3.45 W/cm$^2$, oxygen partial pressure was about 0.5 mTorr and total gas pressure was about 10 mTorr. Sputtering deposition time was either 20 seconds or 30 seconds. Substrate temperature during deposition was about 50° C.

The films were then air annealed by placing the films in an oven, increasing temperature (about a 7 min. warm-up time), maintaining a holding temperature for a specified time, and then turning off the oven for natural cooling.

The effects of adjusting sputtering time and air annealing conditions were investigated (gold contact pads were evaporated on the structures for measuring resistance of the samples and TCR was measured by measuring resistance change in the temperature range of 25° C. to 85° C.). The results appear in Table 3, where TCR1 and TCR2 are TCR values before and after air annealing of the bi-layer structures respectively, and where R1 and R2 are the sheet resistances of the bi-layer structures before and after air annealing respectively.

The results show generally that very high sheet resistances for the structure (over 100 ohms per square) may be achieved in accordance with the process of the invention by decreasing sputtering time and adjusting the annealing conditions for the ruthenium oxide layer. Specifically, bi-layer structures having high sheet resistances are preferably annealed by short-term annealing at a high temperature, then decreasing temperature and annealing at the lower temperature for a longer period. The results further illustrate that high temperature—short term annealing may be used to effectively adjust the TCR of the bi-layer structure.

With reference again to Eq. 1, a comparison of samples 2 and 4 illustrates, as expected, that adjusting the TCR of the capping layer will have a more dramatic impact on the effective TCR of the bi-layer structure where the R1/R2 ratio is increased.

Still further illustrated by examining samples 1–3 or samples 9–12 is that a simple trial and error procedure may be used to determine effective capping-layer annealing parameters for bi-layer films formed using a variety of different process parameters.

Stability of $Ta_2N/RuO_2$ Resistors

Bi-layer structures formed by the process of the invention showed excellent stability when subjected to various aging tests.

EXAMPLE 7

Samples included in Example 5 and samples included in Example 6 were subjected to a 150° C. thermal stability test (from 200 to 500 h) conducted by the method described in Example 1. Two samples from Example 6, upon completion of the thermal stability test, in addition were subjected to a 500 h power aging test, at 100 W/in$^2$, conducted by the method described in Example 2. The results are shown in Table 4, where TCR1 and TCR2 are the TCR's of the samples before and after stability testing respectively, and R1 and R2 resistance (sheet resistance for samples 6-1 to 6-3) before and after stability testing. Except for sample 5-1a, which was annealed at low temperature for an extremely long period, all samples showed modest "bumps" in both TCR and resistance or sheet resistance within the first 100 hours of stability testing. After the first 100 hours, however, TCR remained virtually constant (+/–3 ppm/° C.) and resistance or sheet resistance was not observed to change by more than 0.39% of its value at the 100 h stage. Samples 6-2 and 6-3 showed "bumps" in TCR and sheet resistance within the first 20 h of stability testing, after which time they stabilized. A 20 h burn-in period at 150° C. was sufficient for final stabilization of these samples.

PREFERRED METHODS OF USE

It is known that Ru, as a noble metal, as well as its dioxide $RuO_2$, is insoluble in acids, including aqua regia up to 100° C. $RuO_2$ can only be moderately attacked by aqueous solution of alkaline hypochlorite. Nevertheless, wet etching was tried for patterning of single-layer ruthenium oxide resistors with all the available acids and many different mixes with various ratios. However, none of the solutions used, including aqua regia and reversed aqua regia ($HCL:HNO_3$=1:3), gave observed etching. Although wet etching was not successful, the failure of the patterning technique demonstrates that $RuO_2$ thin film resistors have excellent resistance to chemical erosion.

Preferably, air annealed single-layer ruthenium oxide thin film resistors are patterned by means of a conventional lift-off process.

Insofar as high temperature annealing destroys the photoresist material used during conventional lift-off patterning, dry plasma etching is preferred for patterning in-situ annealed single layer $RuO_2$ films and bi-layer $Ta_2N/RuO_2$ films.[1]

[1] Saito and Kuramasu, *Plasma Etching of RuO2 Thin Films*, J. Appl. Phys. Vol. 31 (1992) pp. 135–138

Alternatively, it is believed that a modified lift-off process may be used for patterning $Ta_2N/RuO_2$ films. Such a process would involve: (1) applying photoresist material to the substrate; (2) performing photolithography using a mask to obtain the photoresist pattern; (3) depositing a layer of $SiO_2$ or similar material capable of withstanding high temperature; (4) performing lift-off as in the conventional process to obtain the SiO2 pattern; (5) depositing $Ta_2N/RuO_2$ bi-layer thin film structures as described (high temperature is allowed); (6) performing a second lift-off in buffered hydroflouride to obtain the final patterned bi-layer thin film resistor. The modified, 2-step lift-off method in fact may find its application in any microelectronics processing where in-situ high temperature annealing is involved.

Gold or silver contact pads may be evaporated on the resistors of the present invention for formation of ohmic contacts. It is highlighted that a special feature of the present invention is that the ruthenium oxide capping layer simplifies the formation of ohmic contact, and improves the properties of the ohmic contacts formed. In contrast to currently available thin film resistors, wherein problems are often observed involving contact resistance and contact adhesion, the single layer and bi-layer resistors of the present invention which employ ruthenium oxide, a highly conductive oxide, as a capping layer, feature a termination layer especially well-suited for metallization.

Another feature concerning the use of the present invention deserving special note is that the resistors described herein enable flexible and economical assembly and packaging. Where currently available resistors are intended for use in hostile thermal, humidity, or chemical environments, it is often required that they are assembled and packaged with special protective coatings or barriers. Due to the toughness, stability, and barrier properties of ruthenium oxide, no such special assembly or packaging is required for the resistors of the present invention.

The above detailed description and examples are intended for purposes of illustrating the invention and are not to be construed as limiting. The invention can be embodied otherwise without departing from the principles thereof, and such other embodiments are intended to fall within the scope of the present invention as defined by the appended claims.

TABLE 2

| Sample | Deposition Time $Ta_2N$ (min.) | Vac. Aneal Temperature (deg. C.) | TCR1 (ppm/°C.) | Annealing Temperature (deg. C.) | Annealing Time (hours) | TCR2 (ppm/°C.) |
|---|---|---|---|---|---|---|
| 1a | 10 | 450 | −768 | 150 | .5 | −653 |
| | | | | 280 | 4.5 | −9.4 |
| | | | | 150 | 4 | −16.2 |
| | | | | 200 | 28* | −5.6 |
| 1b | 10 | 450 | −729 | 200 | 1.5 | −402 |
| | | | | 250 | 73* | −1.4 |
| 2 | 10 | 550 | −206 | 200 | 1 | −83.4 |
| | | | | 200 | 11* | −9.0 |
| 3a | 15 | 550 | −552 | 300 | .5 | −212 |
| | | | | 300 | 3 | −4.1 |
| 3b | 15 | 550 | −544 | 300 | 1 | −55.9 |
| | | | | 300 | 2 | −7.6 |

*Samples were removed from the oven for several interim measurements of TCR during these periods

TABLE 3

| Sample | Depo. $Ta_2N$ (min.) | Depo. $RuO_2$ (sec.) | TCR1 (ppm/°C.) | R1 ohms/ square | Ann. Temp (deg. C.) | Ann. Time (min) | TCR2 (ppm/°C.) | R2 ohms/ square |
|---|---|---|---|---|---|---|---|---|
| 1 | 15 | 30 | −50.6 | 13.30 | 400 | 5 | −13.6 | 14.38 |
| 2 | 15 | 30 | −47.2 | 14.77 | 400 | 10 | 15.7 | 15.99 |
| 3 | 15 | 30 | −57.0 | 13.70 | 400 | 9 | −7.6 | 14.54 |
| 4 | 7.5 | 30 | −101.2 | 29.30 | 400 | 10 | 103.5 | 28.44 |
| 5 | 7.5 | 30 | −103.6 | 30.73 | 400 | 5 | 27.4 | 30.46 |
| 6 | 7.5 | 30 | −100.1 | 35.62 | 400 | 3 | 31.9 | 34.99 |
| 7 | 7.5 | 30 | −100.9 | 34.52 | 350 | 10 | 19.0 | 34.12 |
| 8 | 7.5 | 30 | −102.7 | 32.46 | 300 | 10 | −64.6 | 33.29 |
| 9 | 2 | 20 | −98.7 | 139.11 | 300 | 10 | −17.3 | 136.65 |
| | | | | | 250 | 30 | | |
| 10 | 2 | 20 | −106.8 | 136.20 | 300 | 10 | −23.6 | 133.75 |
| | | | | | 250 | 60 | | |
| 11 | 2 | 20 | −124.3 | 141.15 | 350 | 10 | 75.1 | 137.90 |
| | | | | | 250 | 60 | | |
| 12 | 2 | 20 | −118.1 | 141.69 | 315 | 10 | −11.1 | 138.19 |
| | | | | | 250 | 60 | | |

TABLE 4

| Sample | TCR1 (ppm/°C.) | R1 (ohms) | Stabil. Test (hours) | Power Aging (hours) | TCR2 (ppm/°C.) | R2 (ohms) |
|---|---|---|---|---|---|---|
| 5-1a | −5.6 | 1041 | 100 | — | −5.0 | 1044 |
| | | | 400 | — | −6.7 | 1045 |
| | | | — | 100 | −5.2 | 1044 |
| | | | — | 400 | −4.5 | 1044 |
| 5-1b | −1.4 | 1028 | 100 | — | −7.7 | 1032 |
| | | | 400 | — | −10.3 | 1034 |
| | | | — | 100 | −9.3 | 1034 |
| | | | — | 400 | −6.2 | 1031 |
| 5-2 | −9.0 | 1512 | 100 | — | −15.9 | 1518 |
| | | | 300 | — | −13.6 | 1513 |
| 5-3a | −4.1 | 1339 | 100 | — | −25.4 | 1359 |
| | | | 400 | — | −23.2 | 1361 |
| 5-3b | −7.6 | 1346 | 100 | — | −23.8 | 1364 |
| | | | 100 | — | −22.6 | 1366 |
| 6-1 | −13.6 | 14.38/sq. | 20 | — | −6.7 | 14.48/sq. |
| | | | 80 | — | −17.1 | 14.62/sq. |
| | | | 100 | — | −19.6 | 14.67/sq. |
| 6-2 | 15.7 | 14.77/sq. | 20 | — | 28.1 | 15.90/sq. |
| | | | 80 | — | 23.8 | 15.91/sq. |
| | | | 100 | — | 24.1 | 15.92/sq. |
| 6-3 | −7.6 | 13.70/sq. | 20 | — | 3.3 | 14.45/sq. |
| | | | 80 | — | 1.3 | 14.46/sq. |
| | | | 100 | — | 0.5 | 14.47/sq. |

What is claimed is:

1. A highly stable thin film resistor prepared by the steps of:

(a) providing a substrate;

(b) depositing by vapor deposition with about 0.5 mTorr oxygen partial pressure and about 10 mTorr total gas pressure, solely a thin film layer of ruthenium oxide onto said substrate;

(c) annealing said layer of ruthenium oxide at a temperature of at least about 150° C. for a period of at least about 40 minutes to adjust the temperature coefficient of resistance of said thin film resistor to a near zero value.

2. A method of making a highly stable thin film resistor having a near-zero temperature coefficient of resistance comprising the steps of:

(a) providing a substrate;

(b) vapor depositing, solely a thin film layer of ruthenium oxide onto said substrate;

(c) annealing said thin film layer of ruthenium oxide at a temperature of between about 150° C. and about 250° C. for at least about 40 minutes to adjust the temperature coefficient of resistance of said thin film resistor to a near-zero value.

3. The method of claim 2, wherein said thin film layer of ruthenium oxide is vapor deposited onto said substrate by dc magnetron sputtering.

4. The method of claim 2, wherein the vapor depositing step as described in step (b) lasts up to about 10 minutes and is carried out at a temperature of about 25° C.

5. The method of claim 2 wherein the annealing step as described in step c is in-situ oxygen annealing.

6. The method of claim 5 wherein said annealing step is carried out at a temperature of about 250° C. for about 60 minutes.

7. A highly stable thin film resistor comprising:

a substrate;

a conductive metallic thin film member disposed over said substrate;

said conductive metallic thin film member comprising a thin film layer of annealed ruthenium oxide;

said thin film layer of annealed ruthenium oxide forming an outer protective capping layer upon said thin film resistor;

said thin film resistor having a near zero temperature coefficient of resistance.

8. The highly stable thin film resistor of claim 7 wherein said conductive thin film member further comprises a thin film layer of annealed tantalum nitride disposed between said thin film layer of annealed ruthenium oxide and said substrate.

9. The highly stable thin film resistor of claim 8 wherein said thin film layer of annealed ruthenium oxide and said thin film layer of annealed tantalum nitride have temperature coefficients of resistance of opposite signs.

10. A method of making a highly stable thin film resistor having a near-zero temperature coefficient of resistance comprising the steps of:

(a) providing a substrate;

(b) vapor depositing a thin film conductive member directly upon, and in contact with said substrate, said thin film conductive member comprising a thin film layer of ruthenium oxide upon said substrate forming an outer protective capping layer for said highly stable thin film resistor;

(c) annealing said thin film layer of ruthenium oxide at a temperature of at least about 150° C. for at least about 40 minutes to obtain a near zero temperature coefficient of resistance for said thin film resistor.

11. The method according to claim 10 wherein the annealing step described in step (c) is in-situ oxygen annealing.

12. The method according to claim 10 wherein said thin film conductive member further comprises a thin film layer of tantalum nitride disposed beneath said outer protective capping layer, and wherein step (b) comprises the steps of:

(1) vapor depositing said thin film layer of tantalum nitride upon said substrate;

(2) annealing said thin film layer of tantalum nitride;

(3) vapor depositing said thin film layer of ruthenium oxide upon said thin film layer of tantalum nitride.

13. The method according to claim 12 wherein the annealing step described in step (2) is in-situ vacuum annealing.

14. The method according to claim 12 wherein the annealing step as described in step (2) is carried out for a period of time sufficient to adjust the temperature coefficient of resistance of said thin film layer of tantalum nitride to a value in the range of from about −500 ppm/° C. to about 200 ppm/° C.

15. The method according to claim 12 wherein the annealing step as described in step (2) is carried out for a period of time sufficient to adjust the temperature coefficient of resistance of said thin film layer of tantalum nitride to a value in the range of from about −300 ppm/° C. to about −50 ppm/° C.

16. The method according to claim 12 wherein the annealing step as described in step (2) is carried out for a time sufficient to adjust the temperature coefficient of resistance of said thin film layer of tantalum nitride to a value in the range of from about −30 ppm/° C. to about −140 ppm/° C.

17. The method according to claim 12 wherein step (c) is carried out for a period of time sufficient to adjust the temperature coefficient of resistance of said thin film resistor to a value in the range of about −50 ppm/° C. to about 50 ppm/° C.

* * * * *